United States Patent [19]

Budzich

[11] 4,174,613

[45] * Nov. 20, 1979

[54] LOAD RESPONSIVE VALVE ASSEMBLIES

[76] Inventor: Tadeusz Budzich, 80 Murwood Dr., Moreland Hills, Ohio 44022

[ * ] Notice: The portion of the term of this patent subsequent to Jul. 11, 1995, has been disclaimed.

[21] Appl. No.: 709,204

[22] Filed: Jul. 27, 1976

Related U.S. Application Data

[63] Continuation-in-part of Ser. No. 522,324, Nov. 8, 1974, Pat. No. 3,998,134, and a continuation-in-part of Ser. No. 559,818, Mar. 19, 1975, Pat. No. 3,984,979, and a continuation-in-part of Ser. No. 655,561, Feb. 5, 1976, Pat. No. 4,099,379.

[51] Int. Cl.[2] ..... F15B 13/08

[52] U.S. Cl. ..... 60/427; 60/445; 91/421; 91/436; 91/446; 137/596.13; 137/596.1

[58] Field of Search ..... 60/427, 445; 91/412, 91/421, 436, 446; 137/596.12, 596.13, 596.1

[56] References Cited

U.S. PATENT DOCUMENTS

| | | | |
|---|---|---|---|
| 3,807,447 | 4/1974 | Masuda | 137/596.13 |
| 3,858,393 | 1/1975 | Budzich | 60/427 |
| 3,984,979 | 10/1976 | Budzich | 60/445 |
| 4,099,379 | 7/1978 | Budzich | 137/596.13 X |

*Primary Examiner*—Gerald A. Michalsky

[57] ABSTRACT

A load responsive fluid power multiple load control system using load responsive direction and flow control valves in combination with pump flow control responding to highest system load. Each direction flow control valve is equipped with a load responsive negative load control to control a constant pressure differential at the motor exhaust. The negative load responsive control of each direction control valve blocks the pump flow to the motor while controlling negative load, providing the motor inlet with fluid from the motor exhaust.

22 Claims, 2 Drawing Figures

LOAD RESPONSIVE VALVE ASSEMBLIES

This is a continuation in part of applications Ser. No. 522,324 filed Nov. 8, 1974 for "Load Responsive Fluid Control Valves" now U.S. Pat. No. 3,998,134, Ser. No. 559,818 filed Mar. 19, 1975 for "Load Responsive Fluid Control Valves" now U.S. Pat. No. 3,984,979 and Ser. No. 655,561 filed Feb. 5, 1976 for "Load Responsive Fluid Control System" now U.S. Pat. No. 4,099,379.

BACKGROUND OF THE INVENTION

This invention relates generally to load responsive fluid control valves and to fluid power systems incorporating such valves, which systems are supplied by a single fixed or variable displacement pump. Such control valves are equipped with an automatic negative load responsive control and can be used in a multiple load system, in which a plurality of loads is individually controlled under positive and negative load conditions by separate control valves.

In more particular aspects this invention relates to direction and flow control valves capable of controlling simultaneously a number of loads under both positive and negative load conditions.

In still more particular aspects this invention relates to direction and flow control valves capable of controlling simultaneously multiple positive and negative loads, which while controlling a negative load interrupt pump flow to the motor providing the motor inlet with fluid from the pressurized system exhaust.

Closed center load responsive fluid control valves are very desirable for a number of reasons. They permit load control with reduced power losses and therefore, increased system efficiency and when controlling one load at a time provide a feature of flow control irrespective of the variation in the magnitude of the load. Normally such valves include a load responsive control, which automatically maintains pump discharge pressure at a level higher, by a constant pressure differential, than the pressure required to sustain the load. A variable orifice, introduced between pump and load, varies the flow supplied to the load, each orifice area corresponding to a different flow level, which is maintained constant irrespective of variation in magnitude of the load. The application of such a system is, however, limited by several basic system disadvantages.

Those valves while effective when controlling positive loads do not retain flow control characteristics when controlling negative loads, which instead of taking supply the energy to the fluid system and hence the speed of actuation of such a load in a negative load system will vary with the magnitude of the negative load. Especiallly with socalled overcenter loads, where a positive load may become a negative load, such a valve will lose it speed control characteristics in the negative mode.

This drawback can be overcome by the provision of a load responsive fluid control valve as disclosed in my U.S. Pat. No. 3,744,517 issued July 10, 1973 and my U.S. Pat. No. 3,882,896 issued May 13, 1975. However, while these valves are effective in controlling both positive and negative loads, with pump pressure responding to the highest pressure of a system load being controlled, they still supply, during control of negative loads, the motor inlet with throttled down fluid from the pump circuit, therefore using flow from the pump. In certain fluid power control systems it is preferable, while controlling a negative load, to supply fluid to motor inlet from the motor exhaust circuit instead of using pump capacity.

This drawback can be overcome in part by provision of fluid control valves as disclosed in U.S. Pat. No. 3,807,447 issued to Masuda on Apr. 30, 1974. However, while those valves utilize actuator exhaust fluid for actuator inlet flow requirement when controlling negative loads they regulate actuator inlet pressure by bypassing fluid to a down stream load circuit. Masuda's valves and their proportional control system are based on series type circuit in which excess fluid flow is successively diverted from one valve to the other and in which loads arranged in series determine the system pressure. In such a system flow to the last valve operating a load must be delivered through all of the bypass sections of all of the other system valves, resulting in higher fluid throttling loss. These valves are not adaptable to simultaneous control of multiple loads in parallel circuit operation since they do not provide system load control pressure signal to the pump flow control mechanism. When used with variable displacement pumps these valves are not capable of providing sufficient pressurized exhaust flow to actuator inlet during control of negative load to prevent cavitation.

SUMMARY OF THE INVENTION

It is therefore a principal object of this invention to provide a load responsive fluid control system in which improved load responsive fluid direction and flow control valves block system pump from motor inlet and supply it with system exhaust flow when controlling negative loads, while transmitting control signals to system pump to maintain the pressure of the system pump higher, by a constant pressure differential, than the highest pressure of the system positive load being controlled.

Another object of this invention is to provide a load responsive fluid control system in which load responsive fluid direction and flow control valves are provided with a pressurized exhaust manifold, flow from which supplies the inlet flow requirements of motors controlling negative loads, the system pump being utilized to prevent pressure in the exhaust manifold dropping below a certain predetermined level.

It is another object of this invention to provide a load responsive fluid control system in which load responsive fluid direction and flow control valves retain their control characteristics during control of positive loads, while responding to a pressure differential across a variable orifice located upstream of fluid motor.

Briefly the foregoing and other additional objects and advantages of this invention are accomplished by providing a novel load responsive fluid control system for use during proportional control of positive and negative loads, A system pump is controlled in respect to pressure signal transmitted from system valves, corresponding to the highest system load pressure and maintains a constant pressure differential between the pump pressure and the highest load pressure of positive loads being simultaneously controlled. Exhaust circuit of the system is pressurized, the exhaust flow being used to provide inlet flow requirements of motors controlling negative loads.

Additional objects of this invention will become apparent when referring to the preferred embodiments of the invention as shown in the accompanying drawings and described in the following detailed description.

DESCRIPTION OF THE PREFERRED EMBODIMENTS

Figure 1:
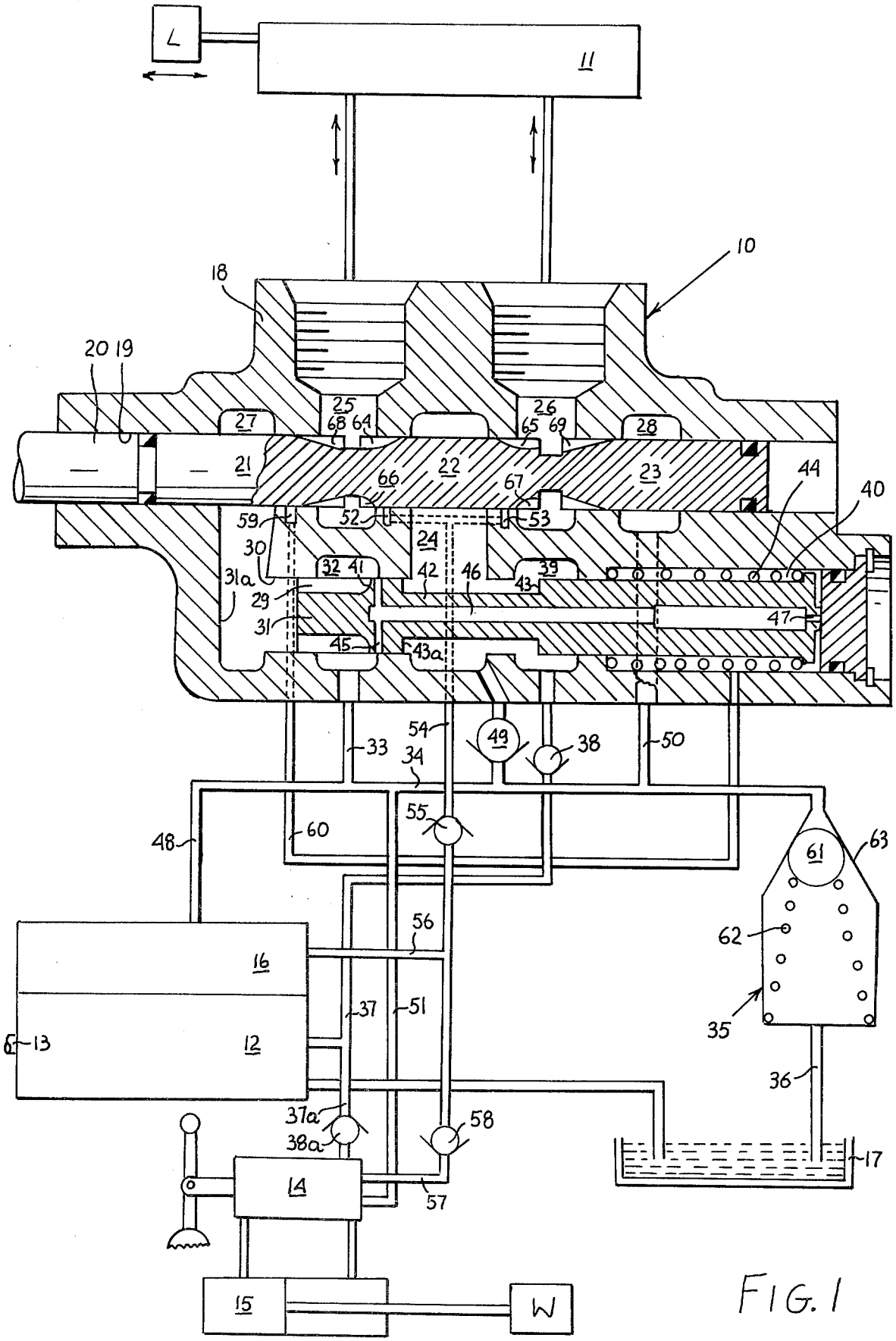
FIG. 1 is a longitudinal sectional view of an embodiment of a flow control valve having a negative load control responsive to actuator down stream pressure differential for use in load responsive fluid control system, with lines, differential pressure relief valve, fixed displacement pump, second load responsive valve, exhaust relief valve and system reservoir shown diagramatically.

Referring now to the drawings and for the present to FIG. 1 embodiment of a flow control valve, generally designated as 10, is shown interposed between a diagramatically shown fluid motor 11 driving load L and a pump 12 of a fixed displacement type driven through a shaft 13 by a prime mover not shown. Similarly, a flow control valve 14, identical to the flow control valve 10, is interposed between a diagramatically shown fluid motor 15 driving a load W and the pump 12. Fluid flow from the pump 12 to flow control valves 10 and 14 is regulated by a differential pressure relief valve 16 which can be mounted as shown on the pump 12, or be an integral part of the flow control valve 10. If the differential pressure relief valve 16 is made part of the valve assembly it is connected to the fixed displacement pump 12 by a high pressure line capable of transmitting full flow of the pump. The differential pressure relief valve 16, in a well known manner, by bypassing fluid from the pump 12 to a reservoir 17, maintains discharge pressure of the pump 12 at a level, higher by a constant pressure differential, than load pressure developed in fluid motor 11 or 15.

The flow control valve 10 although it can be of a three-way type is shown as a fourway type and has a housing 18 provided with bore 19, axially guiding a valve spool 20. The valve spool 20 is equipped with lands 21, 22 and 23 which in neutral position of the valve spool 20, as shown in FIG. 1, isolate a fluid supply chamber 24, load chambers 25 and 26 and outlet chambers 27 and 28. The outlet chamber 27 is cross-connected through slots 29 and control bore 30 guiding a control spool 31 to an exhaust chamber 32, which in turn is connected through exhaust lines 33 and 34, an exhaust relief valve, generally designated as 35 and line 36 to the reservoir 17.

The pump 12 through its discharge line 37 and a check valve 38 is connected to a fluid inlet chamber 39. Similarly the pump 12 is connected through discharge line **37*a* and a check valve 38*a* to fluid inlet chamber of flow control valve 14. Control bore 30 connects the fluid inlet chamber 39 with the fluid supply chamber 24, the fluid exhaust chamber 32 and fluid control space 40. The control spool 31, axially slidable in control bore 30, projects into control space 40 and is provided with slots 29 terminating in throttling edges 41 and stem 42 terminating in cut off plane 43 and control plane 43*a*. The control spool 31 is biased by a control spring 44 towards a position, in which slots 29 connect the outlet chamber 27 with the exhaust chamber 32 and cut off plane 43 permits communication between the fluid inlet chamber 39 and the fluid supply chamber 24. The control spool 31 is equipped with passages 45 and 46 and leakage orifice 47 which communicate control space 40 with the exhaust chamber 32**.

Excess pump flow fom the differential pressure relief valve 16 is delivered through line 48 to exhaust line 34, which communicates with the exhaust chamber 32, a bypass check valve 49, line 50 which connects to the outlet chamber 28, the exhaust relief valve 35 and through line 51 with all of exhaust passages of the flow control valve 14. The bypass check valve 49 is interposed between exhaust line 34 and the fluid supply chamber 24.

Positive load sensing ports 52 and 53, located between load chambers 25 and 26 and the supply chamber 24 and blocked in neutral position of valve spool 20 by land 22, are connected through signal passage 54, a check valve 55 and signal line 56 to the differential pressure relief valve 16. In a similar manner positive load sensing ports of flow control valve 14 are connected through line 57, a check valve 58 and signal line 56 to the differential pressure relief valve 16. A negative load sensing port 59 located between the load chamber 25 and the outlet chamber 27 and blocked in neutral position of valve spool 20 by land 21 is connected through signal passage 60 with control space 40.

The exhaust relief valve, generally designated as 35, interposed between combined exhaust circuits of flow control valves 10 and 14 including bypass circuit of pump 12 and reservoir 17, is provided with a throttling member 61, biased by a spring 62 towards engagement with seat 63.

Land 22 is provided with first metering slots 64 located between the load chamber 25 and the supply chamber 24 and second metering slots 65 located between the load chamber 26 and the supply chamber 24. Land 22 is also provided with shorter communication slots 66 and 67 located in the plane of load sensing ports 52 and 53. Land 21 is provided with first exhaust metering slots 68 located between the load chamber 25 and the outlet chamber 27. Land 23 is provided with second exhaust metering slots 69 located between the load chamber 26 and the outlet chamber 28.

The sequencing of the control spool 31 is such that when moved from right to left, when cut off plane 43 closes communication between the inlet chamber 39 and the supply chamber 24, control plane **43*a* is positioned at the point of opening communication between the supply chamber 24 and the exhaust chamber 32, while full flow communication still exists through slots 29 between the outlet chamber 27 and the exhaust chamber 32. Further movement of the control spool 31 from right to left will gradually close, with throttling edges 41, communication between the exhaust chamber 32 and the outlet chamber 27, while full flow communication between the exhaust chamber 32 and the supply chamber 24** is established.

As previously described with flow control valves 10 and 14 controlling loads L and W the differential pressure relief valve 16, in a well known manner, will regulate fluid flow delivered from the fixed displacement pump 12 to discharge line 37, by bypassing the fluid flow to line 48 and exhaust line 34, to maintain the pressure in discharge line 37 higher, by a constant pressure differential, than the highest load pressure signal transmitted through the check valve system to the signal line 56. Therefore with valve spools of flow control valves 10 and 14 in their neutral position, blocking positive load sensing ports 52 and 53, signal pressure input to the differential pressure relief valve 16 from the signal line 56 will be at minimum pressure level.

With fixed displacement pump 12 started up the differential pressure relief valve 16 will bypass through line 48, exhaust line 34, the exhaust relief valve 35 and line 36 all of pump flow to the system reservoir 17 at minimum pressure level, equivalent to preload in the spring 62, while automatically maintaining pressure in discharge line 37 at a constant pressure, higher by a constant pressure differential, than pressure in signal line 56, which is equal to minimum pressure in exhaust line 34. Therefore all of pump flow is diverted by the differential pressure relief valve 16 to the low pressure exhaust circuit, as previously described, without entering flow passages of flow control valves 10 and 14.

Assume that while constant standby pressure condition is maintained in discharge line 37 the valve spool 20 is initially displaced from left to right to connect the load chamber 25 through communication slot 66 with the positive load sensing port 52, while lands 21, 22 and 23 still block communication between the supply chamber 24, load chambers 25 and 26 and outlet chambers 27 and 28. Assume also that actuator 11 is subjected to a positive load. Load pressure transmitted from actuator 11, the load chamber 25, the positive load sensing port 52 and signal passage 54, in a well known manner, will open the check valve 55, close the check valve 58 and reacting through signal line 56 on the differential pressure relief valve 16 increase pressure in discharge line 37 to maintain a constant pressure differential between the pump pressure in discharge line 37 and load pressure in signal line 56. This pump discharge pressure will be transmitted through discharge line 37 to the fluid inlet chamber 39 and past cut off plane 43 to the fluid supply chamber 24. Since space 40 is connected by leakage orifice 47 and passages 46 and 45 to the exhaust chamber 32, which in turn is connected through the exhaust relief valve 35 to the reservoir 17, the control spool 31 will be in condition of force equilibrium with the control spring 44 maintaining it in position as shown in FIG. 1.

Assume that from the position in which load chamber 25 is connected to the positive load sensing port 52 the valve spool 20 is further displaced to the right, connecting the load chamber 25 with the supply chamber 24 and the load chamber 26 with the outlet chamber 28. The pressure in the load chamber 25 will begin to rise, this change being transmitted through the positive load sensing port 52, in a manner as previously described to the differential pressure relief valve 16, proportionally increasing the pressure in discharge line 37. This increase in positive load pressure in the load chamber 25 will move load L and start fluid flow into the fluid motor 11. In a well known manner the increasing fluid flow through metering slots 64 will result in an increasing pressure drop, until the pressure drop through metering slots 64 will reach the level of controlling pressure differential of the differential pressure relief valve 16. At this point the system will find itself in a state of equilibrium with the differential pressure relief valve 16 regulating the fluid flow into discharge line 37, to maintain a constant pressure drop across metering slots 64. Therefore area of the orifice through the metering slots 64 will determine the velocity of load L. Change in this orifice area, corresponding to displacement of valve spool 20, will vary proportionally the velocity of load L, each specific position of valve spool 20 corresponding to a specific velocity of load L irrespective of variations in the magnitude of load L.

Assume that the valve spools of flow control valves 10 and 14 were simultaneously actuated to a position, at which fluid flow is delivered to actuators 11 and 15. Assume also that load W is higher than load L and that both loads are positive. In a well known manner, the higher of the load pressures will be transmitted through the check valve system in the load sensing circuit, the differential pressure relief valve 16 always responding to the highest system load pressure. In a manner as previously described, the differential pressure relief valve 16 will automatically maintain a constant pressure differential, or constant pressure drop across the metering slots of valve spool of flow control valve 14, permitting proportional control of the velocity of load W, irrespective of the variation in the magnitude of load W. However, flow control valve 10 in a well known manner will lose the proportional flow control feature, the variations in magnitude of load W changing the velocity of load L.

Assume that while constant minimum standby pressure condition is maintained in discharge line 37, the valve spool 20 is initially displaced from right to left connecting the load chamber 26 with positive load sensing port 53 and also connecting the load chamber 25 with the negative load sensing port 59. Assume also that the fluid motor 11 is subjected to a negative load, pressurizing the load chamber 25 and maintaining the load chamber 26 at minimum pressure. Therefore pressure signal, transmitted through the positive load sensing port 53, will not change the setting of differential pressure relief valve 16, the pump 12 maintaining discharge line 37 at minimum pressure level. The negative load pressure from the load chamber 25 will be transmitted through signal passage 60 to control space 40 where, reacting on the cross-sectional area of the control spool 31, it will move the control spool 31 all the way from right to left, first closing off with cut off plane 43 communication between inlet chamber 39 and the supply chamber 24. Control plane **43*a* of the control spool 31 is so positioned that while cut off plane 43 is cutting off communication between the inlet chamber 39 and the supply chamber 24, control plane 43*a* is establishing communication between the supply chamber 24 and the exhaust chamber 32. Further movement to the left of control spool 31 will open wide communication between the supply chamber 24 and the exhaust chamber 32, throttling edge 41 cutting off communication between the outlet chamber 27 and the exhaust chamber 32. Total movement of control spool 31 to the left is limited by face 31*a* of the housing 18. Fluid at negative load pressure from control space 40 will be subjected to leakage through leakage orifice 47, which will be conducted through passages 46 and 45 to the exhaust chamber 32**.

Further movement of valve spool 20 to the left will open communication through the exhaust metering slot 68 between the load chamber 25 and the outlet chamber 27, while also opening communication through metering slots 65 between the load chamber 26 and the supply chamber 24. Rising pressure in outlet chamber 27, reacting on the cross-sectional area of control spool 31 and biasing force of control spring 44, will balance the force, developed on the cross-sectional area of control spool 31 due to the negative load pressure in control space 40 and will move the control spool 31 from left to right into a modulating position, in which the control spool 31, by throttling action of throttling edge 41, will maintain a constant pressure differential across the orifice created by displacement of the exhaust metering slots 68. Therefore for each position of valve spool 20, corresponding to a specific area of flow across exhaust metering slots 68, constant flow will take place from the load chamber 25 to the outlet chamber 27, irrespective of the variation in the magnitude of the negative load in the actuator 11. High pressure flow out of actuator 11, during control of negative load, will be replenished on the other side of actuator from the exhaust chamber 32 through the opening created by displacement of the control plane 43*a* in respect to the exhaust chamber 32 connecting exhaust chamber 32 and the supply chamber 24 and from exhaust line 34 through the bypass check valve 49, at an increased pressure level of exhaust relief valve 35, while utilizing a combined exhaust flow from the exhaust chamber 32 and the differential pressure relief valve 16. The exhaust fluid at increased pressure is supplied to the actuator inlet during control of negative load, while the fixed displacement pump 12 is completely isolated by cut off plane 43 from the supply chamber 24 and the actuator 11. Therefore, since none of the potential pump delivery is used as actuator make-up fluid, during control of negative load, higher pump capacity is made available for simultaneous control of multiple positive loads. During control of two negative loads, for example loads L and W, the exhaust circuit is also supplied by line 51 with exhaust fluid from the flow control valve 14, the combined exhaust flow of both control valves and the bypass flow from the differential pressure relief valve 16 being available for the make-up flow to the system actuators controlling negative loads, while full pump capacity is being saved for operation of the other positive loads.

When negative load is controlled from one load chamber only, which is the case for example with a fluid cylinder lifting and lowering a load, metering slots in the other load chamber can be dispersed with. Assume that the load chamber 25 is subjected to positive and negative load and that load chamber 26 is subjected to pressure in the exhaust manifold. Then metering slots 65 and 69, communication slot 67 and positive load sensing port 53 can be dispensed with and valve spool 20 modified so it would connect with large areas of flow the load chamber 26 with the supply chamber 24 and the outlet chamber 28, before the load chamber 25 is connected to the supply chamber 24 or the outlet chamber 27. This modification to the valve spool would provide minimum exhaust throttling loss. This type of timing is made possible by the negative load control feature, which during control of negative load cuts off communication between the pump and the supply chamber, the actuator's inlet flow demand being supplied from the valve exhaust circuit.

When valve spool 20 is moved rapidly from left to right connecting the fluid supply chamber 24 with the load chamber 25, unless the differential pressure relief valve 16 responds fast enough to raise the discharge pressure in the discharge line 37 and the supply chamber 24 to the level, equal to or higher than the load pressure existing in the load chamber 25, a back flow from load chamber 25 to the fixed displacement pump 12 can take place, resulting in momentary drop in load L. To prevent this back flow, check valves 38 and 38*a* are provided in the pump discharge line. Check valves 38 and 38*a*, while preventing back flow, permit the differential pressure relief valve 16 to raise the pump pressure to a level at which the check valves 38 and 38*a* will open permitting free flow between the pump and the actuator.

Figure 2:
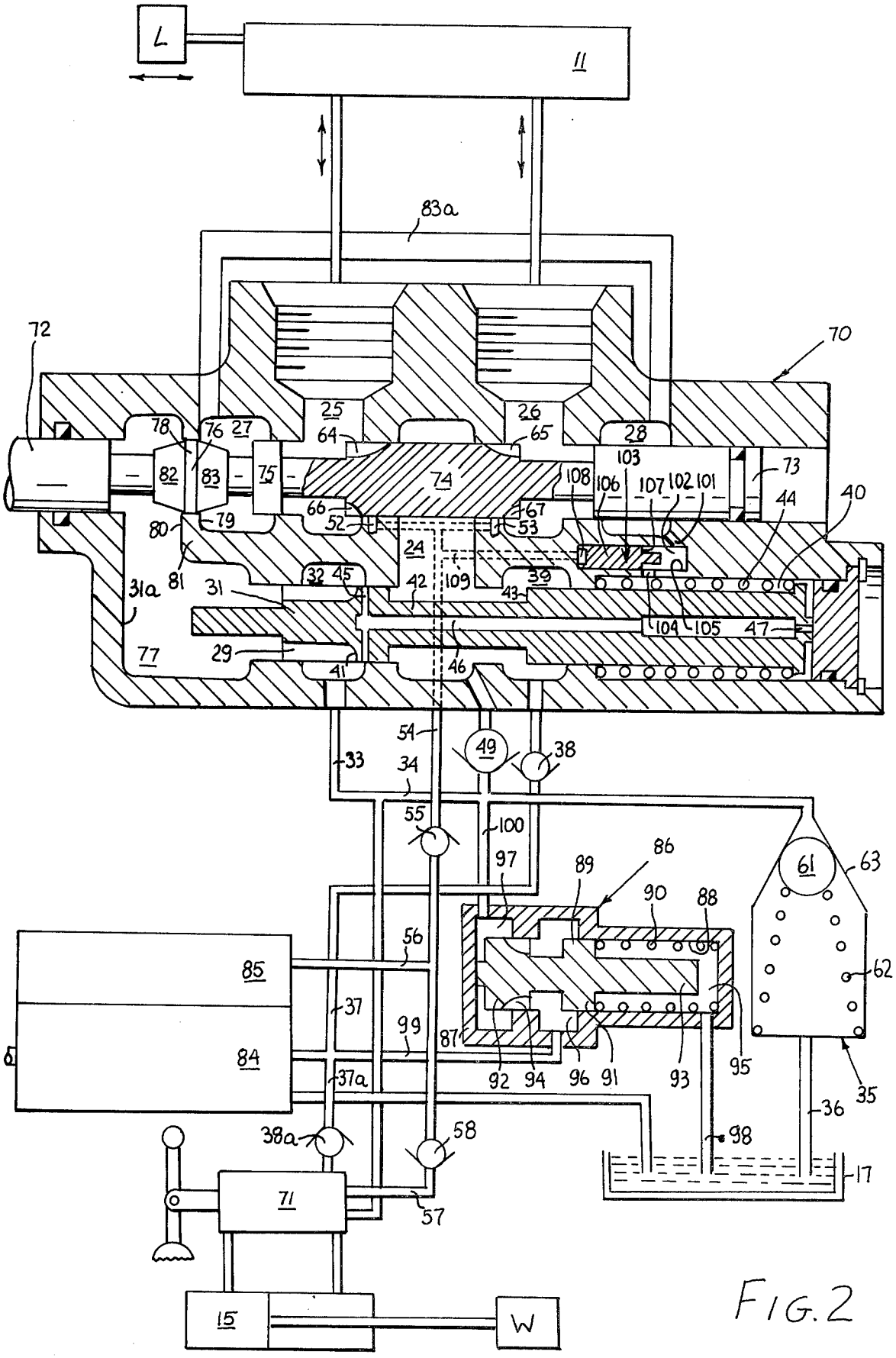
FIG. 2 is a sectional view of a similar embodiment of flow control valve of FIG. 1 used in a load responsive fluid control system with lines, variable displacement pump equipped with differential pressure compensator, second load responsive valve, exhaust relief valve, exhaust pressure reducing valve and system reservoir shown diagramatically.

Referring now to the FIG. 2 flow control valves, generally designated as 70 and 71, are similar to those of FIG. 1 in that they perform their control functions in control of loads L and W in a similar way. The basic function and configuration of flow control spool 31 is the same for flow control valves 10 and 70. Positive load sensing circuit of flow control valves 10 and 70 with their check valve systems are again identical, the positive load pressure of the highest system load being transmitted to signal line 56. However, a valve spool 72 is equipped with lands 73, 74 and 75, and a metering land 76 which in neutral position of valve spool 72 isolate load chambers 25 and 26 from the supply chamber 24, outlet chambers 27 and 28 and an unloading chamber 77. The valve spool 72 is also provided with metering slots 64 and 65, positioned between respective load chambers and the supply chamber of flow control valve 70. Metering land 76 is provided with sealing surface 78, centrally located between flow surfaces 79 and 80 of a web 81, with valve spool 72 positioned as shown in FIG. 2, and two conical metering surfaces 82 and 83. In a well known manner conical surfaces 82 and 83 can be substituted by suitable metering grooves. Outlet chambers 27 and 28 are connected with each other by outlet duct 83*a*. A pump 84 is of a variable displacement type and is controlled by a differential pressure compensator 85 which, in a well known manner, varies the displacement of the pump 84 to maintain discharge line 37 at a pressure, higher by a constant pressure differential, than the load signal pressure transmitted to the differential pressure compensator 85 from the load sensing circuit by signal line 56. Therefore in both systems, as shown in FIGS. 1 and 2, by control of pump flow delivered to discharge line 37, a constant pressure differential is maintained between pressure in discharge line 37 and pressure in signal line 56, in response to highest system load being operated. The differential pressure compensator 85 can be an integral part of pump 84 or can be part of flow control valve 70. Although the load control features of the systems in FIGS. 1 and 2, as will be shown are identical, the amount of flow delivered to exhaust circuit and specifically to exhaust line 34 is different for each circuit. In FIG. 1 all of the excess pump flow is delivered by the differential pressure relief valve 16 through line 48 to exhaust line 34, since the pump 12 is of a fixed displacement type. With system valve spools in neutral position all of the pump flow is directed by the differential pressure relief valve 16 to exhaust line 34. In FIG. 2 since the pump 84 is of a variable displacement type, it supplies the exact amount of fluid to satisfy the system demand, none of the pump flow being normally diverted to exhaust line 34. Therefore in the arrangement of FIG. 2 less exhaust flow is available to satisfy inlet flow requirements of system actuators during control of negative loads. Normally an actuator, in the form of a cylinder, due to presence of a piston rod, displaces different flows from each cylinder port per unit length displacement of its piston. Therefore, while controlling negative load, the exhaust flow out of the cylinder might be substantially smaller than its inlet flow requirements. Under those conditions, since communication between the inlet chamber 39 and the supply chamber 24 is blocked by the control spool 31, exhaust pressure level, as maintained by exhaust pressure relief valve 35 will drop below atmospheric pressure, the exhaust pressure relief valve 35 will close entirely and cavitation will take place at the inlet side of the cylinder. In a well known manner an anti-cavitation check valve could be provided between exhaust line 34 and reservoir 17, but since it can only function below atmospheric pressure the cavitation condition at actuator inlet would still likely occur. To prevent cavitation and to maintain exhaust line 34 at minimum pressure level a pressure reducing valve, generally designated as 86, is provided. Pressure reducing valve 86 has a valve housing 87 provided with a valve bore 88 axially guiding a valve spool 89, which is biased twoards postion as shown in FIG. 2 by a spring 90. The valve spool 89 is provided with lands 91 and 92, stop 93 and throttling slots 94. The valve housing 87 is provided with space 95 and chambers 96 and 97. Space 95 is connected through line 98 with the reservoir 17. The chamber 96 is connected by line 99 with discharge line 37, which is supplied with fluid under pressure from the pump 84. The chamber 97 is connected by line 100 with exhaust line 34. Fluid under pressure is supplied from pump 84, discharge line 37 and line 99 to the chamber 96 and through throttling slots 94 to the chamber 97, which is connected by line 100 with exhaust line 34. Pressure in the chamber 97 and in the exhaust system will begin to rise and reacting on the cross-sectional area of valve spool 89 will tend to move it from left to right, compressing the spring 90 and closing the passage through throttling slots 94 between chambers 97 and 96. In this way pressure reducing valve 86 will throttle fluid flow from chamber 96 to chamber 97 and therefore to exhaust line 34, to maintain exhaust line 34 at a constant pressure, as dictated by the preload in the spring 90. This constant controlled pressure level is selected below controlled pressure level of exhaust pressure relief valve 35. As long as the exhaust pressure relief valve 35 maintains the exhaust system at its controlled pressure level, communication between chambers 96 and 97 of pressure reducing valve 86 will be closed and no flow from the pump 84 will be diverted into the exhaust circuit, to maintain it at a minimum constant pressure level. However, during control of negative load, once the actuator inlet flow requirement will exceed the actuator outlet flow, the exhaust pressure relief valve 35 will close, pressure in the exhaust system will drop to the control pressure setting of the pressure reducing valve 86 and the motor exhaust flow will be supplemented from the pump circuit by the pressure reducing valve 86, to maintain the actuator inlet at the required pressure. Therefore during control of negative load only the difference between the fluid motor inlet flow requirement and the fluid motor exhaust flow will be supplied to the exhaust circuit from the pump 84. This feature not only improves the efficiency of the system, but greatly extends the capacity of the pump of variable displacement type, to perform useful work in control of positive loads.

The output chamber 27, outlet duct 83*a* and the outlet chamber 28 are connected by signal passage 101 with a chamber 102 of an interlock, generally designated as 103, the interlock 103 is interposed between signal passage 101 and signal passage 104, leading to control space 40. The interlock 103 has bore 105, slidably guiding an interlock spool 106, equipped with cut off edge 107. A chamber 108 communicates with one end of the interlock spool 106 and is connected through control passage 109 to signal passage 54. The interlock spool 106 is subjected to pressure differential existing in chambers 102 and 108 and therefore to pressure differential existing between outlet chambers 27 and 28 and positive load sensing ports 52 and 53. With negative load pressure in outlet chambers 27 and 28, higher than the pressure in positive load sensing ports 52 and 53, the interlock spool 106 will be forcibly maintained in the position as shown in FIG. 2, permitting free communication between the outlet chamber 28 and control space 40 by signal passage 101, the chamber 102 and signal passage 104. Under these conditions the control spool 31 is free to control a negative load. With pressure in positive load sensing ports 52 and 53 higher than pressure in the outlet chambers 27 and 28, signifying presence of a positive load, the interlock spool 106 is shuttled all the way from left to right, cut off edge 107 blocking signal passage 104 and effectively closing communication between outlet chambers 27 and 28 and control space 40, making the negative load control inactive. Therefore any small fluctuations in pressure in outlet chambers 27 and 28 due to resistance to flow past metering surfaces 82 and 83, during control of positive load, will not affect the negative load control.

The preferred sequencing of connections made by the valve spool 72 between various chambers and passages is as follows. Initial displacement in either direction of valve spool 72 connects through communication slots 66 and 67 one of the load chambers with corresponding positive load pressure sensing port 52 or 53, simultaneously connecting the other load chamber with one of the outlet chambers 27 or 28, while sealing surface 78 of the metering land 76 remains in sealing contact with the web 81. Further displacement of the valve spool 72 simultaneously connects one of the load chambers with the fluid supply chamber 24 and the outlet chamber 27 with the unloading chamber 77, creating an area of orifice between flow surface 80 or 79 and conical metering surface 83 or 82.

Assume that while constant standby pressure condition is maintained in discharge line 37 the valve spool 72 is initially displaced from left to right, connecting positive load sensing port 52 through communication slot 66 with the load chamber 25 and also connecting outlet chamber 28 with the load chamber 26 while land 74 still isolates the load chamber 25 from the supply chamber 24 and the metering land 76 isolates the outlet chamber 27 from the unloading chamber 77. Assume also that the fluid motor 11 is subjected to a positive load, with the load chamber 25 pressurized and the load chamber 26 subjected to minimum pressure. In a manner as previously described the interlock 103 will cut off communication between outlet chambers 27 and 28 and control space 40, making the negative load control inactive. The positive load pressure signal, transmitted through the positive load sensing port 52 will, in a manner as previously described, bring the discharge pressure of the pump 84 in discharge line 37 to a level, higher by a constant pressure differential, than the load pressure signal transmitted through the load sensing circuit and signal line 56 to the differential pressure compensator 85.

Assume that the spool 72 is further displaced from left to right connecting the load chamber 25 with the supply chamber 24 and the outlet chamber 27, through the metering surface 82, with the unloading chamber 77. The pressure in the load chamber 25 will begin to rise, this change being transmitted through the positive load sensing port 52, in a manner as previously described, to the differential pressure compensator 85 controlling the flow of variable displacement pump 84. The differential pressure compensator 85 will proportionally increase the pressure in discharge line 37. This increase in positive load pressure in the load chamber 25 will move load L and start fluid flow into the fluid motor 11. In a well known manner, the increasing fluid flow through metering slots 64 will result in an increasing pressure drop, until the pressure drop through metering slots 64 will reach the level of controlling pressure differential of the differential pressure compensator control 85. At this point the system will find itself in a state of equilibrium with the differential pressure compensator 85 regulating the displacement of the variable displacement pump 84 and therefore the fluid flow into discharge line 37, to maintain a constant pressure drop across metering slots 64. Therefore the area of the orifice through metering slots 64 will determine the velocity of the load L. Change in this orifice area, corresponding to displacement of valve spool 72, will vary proportionally the velocity of load L, each specific position of valve spool 72 corresponding to a specific velocity of load L irrespective of variations in the magnitude of the load L.

Assume that valve spool 72 was displaced from left to right, connecting load chamber 25 with positive load sensing port 52 through communication slot 66 and the load chamber 26 with the outlet chamber 28 while land 74 still isolates the load chamber 25 from the supply chamber 24 and the metering land 76 isolates the outlet chamber 27 from the unloading chamber 77. Assume also that the actuator 11 is subjected to a negative load, with the load chamber 26 pressurized and the load chamber 25 subjected to minimum pressure. The minimum pressure signal, transmitted from the load chamber 25 through the positive load sensing circuit and signal line 56 to the differential pressure compensator 85, will maintain the discharge line 37 of the pump 84 at minimum pressure level. Negative load pressure signal, transmitted from the outlet chamber 28, signal passage 101, the chamber 102 and signal passage 104 to control space 40, will react on the cross-sectional area of control spool 31 moving it all the way from right to left and in a manner, as previously described when referring to FIG. 1, will close off communication between the inlet chamber 39 and the supply chamber 24, connect the supply chamber 24 with the exhaust chamber 32 and close off communication by throttling edge 41 between the exhaust chamber 32 and the unloading chamber 77.

Assume that valve spool 72 is further displaced from left to right, connecting the load chamber 25 with the supply chamber 24 and also connecting through metering surface 82 the outlet chamber 27 with the unloading chamber 77. The pressure in the unloading chamber 77 will begin to rise, reacting on the cross-sectional area of the control spool 31 and generating a force acting in the same direction as the biasing force of the control spring 44 and opposing a force developed on the cross-sectional area of the control spool 31 by pressure in control space 40. In a manner, as previously described, when referring to FIG. 1, the control spool 31 will move into a modulating position, throttling fluid flow between the unloading chamber 77 and the exhaust chamber 32 by throttling edge 41, to maintain a constant pressure differential between the outlet chamber 27 and the unloading chamber 77 across the metering land 76. With constant pressure differential maintained across an orifice created by metering surface 82, the fluid flow from the load chamber 26 to the unloading chamber 77 will be proportional to the area of the created orifice and therefore to the displacement of the valve spool 72 from its neutral position and completely independent of the magnitude of the negative load L. The inlet flow requirement of actuator 11 will be supplied directly from the exhaust chamber 32 to the supply chamber 24, this flow if required being supplemented by flow through bypass check valve 49, supplied by pressure reducing valve 86 from the outlet of the pump 84.

Assume that flow control valves 70 and 71 simultaneously control loads L and W. Assume also that lead L is negative while load W is positive. In a manner as previously described control spool 31 will cut off communication between the pump 84 and the supply chamber 24 and proportionally control negative load L, while inlet flow to the fluid motor 11 is supplied from the combined exhaust manifold of the flow control valves 70 and 71, at a pressure as dictated by the exhaust relief valve 35. The positive load W will be controlled also in a manner as previously described by differential pressure compensator 85, of the variable displacement pump 84, automatically maintaining a constant pressure differential between the pump discharge pressure and the pressure of the positive load W. Operation of negative load L does not in any way affect the performance of the variable displacement pump 84. This feature not only increases the efficiency of the system but prevents fluid motor 11 from overloading, by being subjected to the pump pressure while supporting a negative load.

The differential pressure compensator 85 may be, in a conventional way, mounted directly on the variable displacement pump 84 or can be made a part of the valve assembly. If the differential pressure compensator 85 is made part of the valve assembly it is connected to the variable displacement pump 84 by three lines, one line at pump discharge pressure, one line at reservoir pressure and one line for conducting of modulated control signal to the displacement changing mechanism of the variable displacement pump 84.

Although the preferred embodiments of this invention have been shown and described in detail it is recognized that the invention is not limited to the precise form and structure shown and various modifications and rearrangements as will occur to those skilled in the art upon full comprehension of this invention may be resorted to without departing from the scope of the invention as defined in the claims.

What is claimed is:

1. Multiple load responsive valve assemblies each comprising a housing having a fluid inlet chamber connected to pump means, a fluid supply chamber, at least one load chamber, outlet fluid conducting means and fluid exhaust means connected to reservoir means, first valve means for selectively interconnecting said fluid load chamber with said fluid supply chamber and said fluid exhaust means, said first valve means having first variable metering orifice means operable to throttle fluid flow between said load chamber and said fluid exhaust means and second variable orifice means operable to throttle fluid flow between said fluid supply chamber and said load chamber, pressure sensing port means selectively communicable with said load chamber by said first valve means, second valve means having out flow throttling means between said load chamber and said fluid exhaust means, said second valve means having means responsive to pressure differential at variable pressure level across said first variable orifice means and operable to maintain said pressure differential across said first variable orifice means at a relatively constant preselected level while pressure at said first variable orifice means is permitted to vary, said second valve means having fluid isolating means between said fluid inlet chamber and said fluid supply chamber, fluid replenishing means to interconnect for fluid flow said fluid supply chamber and said fluid exhaust means when said fluid isolating means isolates said fluid supply chamber and said fluid inlet chamber, and control means connected to said inlet chambers of said valve assemblies, control line means interconnecting said control means with said pressure sensing port means of said valve assemblies, control signal direction phasing means in each of said control line means, said control means responsive to highest pressure in any of said load chambers of valve assemblies operating loads and operable to vary fluid flow delivered from said pump means to said load system to maintain a constant pressure differential across said second variable orifice means between pressure in said inlet chambers and said maximum pressure in said load chamber.

2. Multiple load responsive valve assemblies as set forth in claim 1 wherein said first valve means includes a valve spool axially guided in a valve bore and movable from a neutral position to at least two actuated positions, said valve spool isolating said load chamber from said supply chamber and said fluid exhaust means when in neutral position and when displaced from neutral position first uncovering a control signal passage means in the region of said spool bore between said load chamber and said fluid supply chamber.

3. Multiple load responsive valve assemblies as set forth in claim 1 wherein said fluid replenishing means have fluid connecting means on said second valve means operable to connect for fluid flow said fluid supply chamber with said fluid exhaust means when said fluid isolating means isolates said fluid inlet chamber from said fluid supply chamber.

4. Multiple load responsive valve assemblies as set forth in claim 1 wherein said fluid replenishing means have suction check valve means interconnecting for one way fluid flow said fluid exhaust means and said fluid supply chamber.

5. Multiple load responsive valve assemblies as set forth in claim 4 wherein duct means interconnect said fluid exhaust means of said valve assemblies with said reservoir means, exhaust pressure relief valve means in said duct means interposed between said valve assemblies and said reservoir means said suction check valve means interconnecting said fluid supply chambers of said valve assemblies with said duct means upstream of said exhaust pressure relief valve means.

6. Multiple load responsive valve assemblies as set forth in claim 5 wherein constant pressure reducing valve means interconnect said inlet chambers of said valve assemblies and said duct means upstream of said exhaust pressure relief valve means and operable to maintain said duct means upstream of said exhaust pressure relief valve means at a constant pressure level lower than pressure setting of said exhaust pressure relief valve means when said exhaust pressure relief valve means stop passing fluid from said load responsive valve assemblies to said reservoir means.

7. Multiple load responsive valve assemblies as set forth in claim 1 wherein said control means has fluid bypass means to vary fluid flow delivered from said pump means to said valve assemblies and fluid conducting means to conduct said fluid from said bypass means to said fluid replenishing means.

8. Multiple load responsive valve assemblies as set forth in claim 1 wherein said control means has pump displacement changing control means to vary fluid flow delivered from said pump means to said multiple load responsive valve assemblies.

9. Multiple load responsive valve assemblies as set forth in claim 1 wherein check valve means are interposed between said pump means and each of said inlet chambers to prevent fluid back flow from said inlet chambers to said pump means.

10. Multiple load responsive valve assemblies as set forth in claim 1 wherein said out flow throttling means has means operable to control fluid flow from said load chamber to said exhaust means to maintain said pressure differential across said first variable orifice means at a relatively constant preselected level when one of said load chambers is connected through said first variable orifice means to said exhaust means and said load chamber is pressurized.

11. Multiple load responsive valve assemblies as set forth in claim 1 wherein said control signal direction phasing means include check valve means.

12. A load responsive valve assembly comprising a housing having a fluid inlet chamber connected to pump means, a fluid supply chamber, first and second load chambers, outlet fluid conducting means, fluid exhaust means connected to reservoir means, and pressure sensing port means between said fluid supply chamber and said fluid load chambers, first valve means for selectively interconnecting said fluid load chambers with said pressure sensing port means, said fluid supply chamber and said fluid exhaust means, said first valve means having first first variable metering orifice means operable to throttle fluid flow between at least one load chamber and said fluid exhaust means and second variable orifice means operable to throttle fluid flow between said fluid supply chamber and at least one load chamber, second valve means having out flow throttling means between said load chambers and said fluid exhaust means, said second valve means having means responsive to pressure differential at variable pressure level across said first variable orifice means and operable to maintain said pressure differential across said first variable orifice means at a relatively constant preselected pressure level while pressure at said first variable orifice means is permitted to vary, said second valve means having fluid isolating means between said fluid inlet chamber and said fluid supply chamber, fluid replenishing means to interconnect for fluid flow said fluid supply chamber and said fluid exhaust means when said fluid isolating means isolates said fluid supply chamber and said fluid inlet chamber, duct means interconnecting said fluid exhaust means of said valve assembly with said reservoir means, and control means connected to said inlet chamber of said valve assembly, control line means interconnecting said control means with said pressure sensing port means of said valve assembly, check valve means in said control line means, said control means responsive to pressure in said load chamber of said valve assembly connected by said first valve means to said inlet chamber and operable to vary fluid flow delivered from said pump means to said valve assembly to maintain a constant pressure differential across said second variable orifice means between pressure in said inlet chamber and pressure in said load chamber.

13. A load responsive valve assembly as set forth in claim 12 wherein said housing of said valve assembly has deactivating means to deactivate said second valve means when said supply chamber is connected to one of said load chambers and said load chamber is pressurized.

14. A load responsive valve assembly as set forth in claim 13 wherein said deactivating means are responsive to pressure in said pressure sensing port means and to pressure upstream of said first variable metering orifice means.

15. A load responsive valve assembly as set forth in claim 12 wherein said fluid replenishing means have fluid connecting means on said second valve means operable to connect for fluid flow said fluid supply chamber with said fluid exhaust means when said fluid isolating means isolates said fluid inlet chamber from said fluid supply chamber.

16. A load responsive valve assembly as set forth in claim 12 wherein said fluid replenishing means have suction check valve means interconnecting for one way fluid flow said duct means and said fluid supply chamber.

17. A load responsive valve assembly as set forth in claim 12 wherein said control means has fluid bypass means to vary fluid flow delivered from said pump means to said valve assembly, fluid conducting means to conduct said fluid from said bypass means to said duct means and exhaust pressure relief valve means interposed between said duct means and said reservoir means.

18. A load responsive valve assembly as set forth in claim 12 wherein said first valve means includes a valve spool axially guided in a valve bore and movable from a neutral position to at least two actuated positions, said valve spool isolating said load chambers from said supply chamber and said fluid exhaust means when in neutral position and when displaced from neutral position first uncovering a control signal passage means in the region of said spool bore between one of said load chambers and said fluid supply chamber.

19. A load responsive valve assembly as set forth in claim 12 wherein said housing has a fluid outlet chamber interposed between said load chambers and said outlet fluid conducting means, said first variable metering orifice means selectively interconnecting said fluid outlet chamber and said outlet fluid conducting means.

20. A load responsive valve assembly as set forth in claim 12 wherein said control means has pump displacement changing control means to vary fluid flow delivered from said pump means to said load responsive valve assembly.

21. A load responsive valve assembly as set forth in claim 12 wherein exhaust pressure relief valve means in said duct means is interposed between said valve assembly and said reservoir means.

22. A load responsive valve assembly as set forth in claim 21 wherein constant pressure reducing valve means interconnects said inlet chamber of said valve assembly and said duct means upstream of said exhaust pressure relief valve means and operable to maintain said duct means upstream of said exhaust pressure relief valve means at a constant pressure level lower than pressure setting of said exhaust pressure relief valve means when said exhaust pressure relief valve means stop passing fluid from said load responsive valve assembly.

* * * * *